US009480893B1

(12) United States Patent
Sonderman

(10) Patent No.: US 9,480,893 B1
(45) Date of Patent: Nov. 1, 2016

(54) METHOD AND APPARATUS FOR CONDITIONING A LACROSSE STICK

(71) Applicant: Michael W. Sonderman, Akron, OH (US)

(72) Inventor: Michael W. Sonderman, Akron, OH (US)

( * ) Notice: Subject to any disclaimer, the term of this patent is extended or adjusted under 35 U.S.C. 154(b) by 22 days.

(21) Appl. No.: 14/255,284

(22) Filed: Apr. 17, 2014

Related U.S. Application Data

(60) Provisional application No. 61/823,694, filed on May 15, 2013.

(51) Int. Cl.
*B29C 33/30* (2006.01)
*B29C 53/80* (2006.01)
*A63B 59/00* (2015.01)

(52) U.S. Cl.
CPC ..... *A63B 59/0074* (2013.01)

(58) Field of Classification Search
CPC ..... A63B 59/0074
USPC ..... 425/318, 383, 385; 473/513
See application file for complete search history.

(56) References Cited

U.S. PATENT DOCUMENTS

| | | | | |
|---|---|---|---|---|
| 5,425,541 | A | 6/1995 | Ambros | |
| 5,638,999 | A | 6/1997 | Greene | |
| 7,160,098 | B2 * | 1/2007 | Ingles | A21C 11/16 100/293 |
| 7,244,200 | B2 | 7/2007 | Goldberg | |
| 7,445,571 | B2 | 11/2008 | Winningham | |
| 7,494,332 | B2 * | 2/2009 | Galomb | B29C 45/03 29/469 |
| 7,972,228 | B1 | 7/2011 | Dikmanis et al. | |

* cited by examiner

*Primary Examiner* — Joseph S Del Sole
*Assistant Examiner* — Thukhanh T Nguyen
(74) *Attorney, Agent, or Firm* — Vorys, Sater, Seymour and Pease LLP

(57) ABSTRACT

Provided is a lacrosse stick conditioning apparatus comprising a retainer, a lever, and a conditioning tool. The retainer may be adapted to hold a lacrosse stick in a substantially fixed position relative to the retainer. The lever may be rotatably mounted relative to the retainer at a primary axis. The lever may having one or more conditioning tool mounts, each mount being adapted for pivotable engagement of a conditioning tool, and defining a mount axis parallel to and offset from the primary axis. The conditioning tool may be rotatably engageable with any of the tool mounts and may have a conditioning tool head engaged therewith.

10 Claims, 9 Drawing Sheets

METHOD AND APPARATUS FOR CONDITIONING A LACROSSE STICK

This application claims the benefit of U.S. provisional patent application 61/823,694, filed May 15, 2013 and which is hereby incorporated by reference.

BACKGROUND

The present subject matter relates generally to the conditioning of a sporting goods article. More particularly the present subject matter relates to shaping, forming, or breaking-in at least part of a lacrosse stick.

A lacrosse stick is an article adapted for playing lacrosse. It is sometimes desirable to soften, shape, break-in, or otherwise condition at least part of the head of the lacrosse stick to soften the mesh, or form a pocket in the mesh, or to otherwise make it effective or improve its effectiveness at performing the function of catching, carrying, or throwing a lacrosse ball.

It remains desirable to provide a method and apparatus for conditioning a lacrosse stick.

SUMMARY OF THE DISCLOSURE

Provided is a lacrosse stick conditioning apparatus comprising a retainer, a lever, and a conditioning tool. The retainer may be adapted to hold a lacrosse stick in a substantially fixed position relative to the retainer. The lever may be rotatably mounted relative to the retainer at a primary axis. The lever may having one or more conditioning tool mounts, each mount being adapted for pivotable engagement of a conditioning tool, and defining a mount axis parallel to and offset from the primary axis. The conditioning tool may be rotatably engageable with any of the tool mounts and may have a conditioning tool head engaged therewith.

DETAILED DESCRIPTION

Conditioning of a lacrosse stick 200 is altering the original condition of the lacrosse stick 200 to suit a particular user or application. Conditioning of a lacrosse stick 200 may comprise, without limitation, shaping one or more portions of the lacrosse stick 200 such as a part of the head 210 such as the mesh 220. For example, and without limitation, a lacrosse stick 200 will generally comprise a head 210 having a mesh 220 adapted to receive and retain a ball. It may be desirable to shape the mesh 220 of a lacrosse stick 200 to form a pocket in some region thereof adapted to conform to an associated ball.

Some conditioning operations on a lacrosse stick 200 may comprise working the mesh 220 to be conditioned. Working of the mesh 220 may comprise pressing, pounding, hammering, stretching, or other work operations. For a lacrosse stick 200 adapted to receive, catch, hold, carry, or otherwise engage with an associated ball, a ball or tool having a ball-shaped portion, may be used as a tool for the conditioning operation. It may be desirable to condition mesh 220 to a desired pliability or to form a pocket of desired shape, position, or depth, or some combination thereof.

In some conditioning operations, it may be desirable to apply a very large force to the mesh 220. This latter force may substantially greater force than even a very strong user can readily and comfortably apply without the assistance of some kind of mechanical advantage. In some conditioning operations, it may be desirable to apply any of a range of forces to the lacrosse stick 200 through a conditioning tool of a specific size and shape to any of a range of positions on the lacrosse stick 200. For example, and without limitations, in forming a pocket in the mesh 220 of a lacrosse stick 200, it may be desirable to apply a very large force through a conditioning tool head 180 having the shape and size of a regulation lacrosse ball so as to produce a deep impression shaped like the negative of the impressed portion of the conditioning tool head 180, and thereby shaped to closely conform to at least a portion of a regulation lacrosse ball. The depth and placement of a pocket in a lacrosse stick 200 may depend on the intended usage of the lacrosse stick 200, such as, without limitation, whether it is intended to be used primarily for throwing the ball or primarily for carrying the ball, and user preferences.

Figure 1:
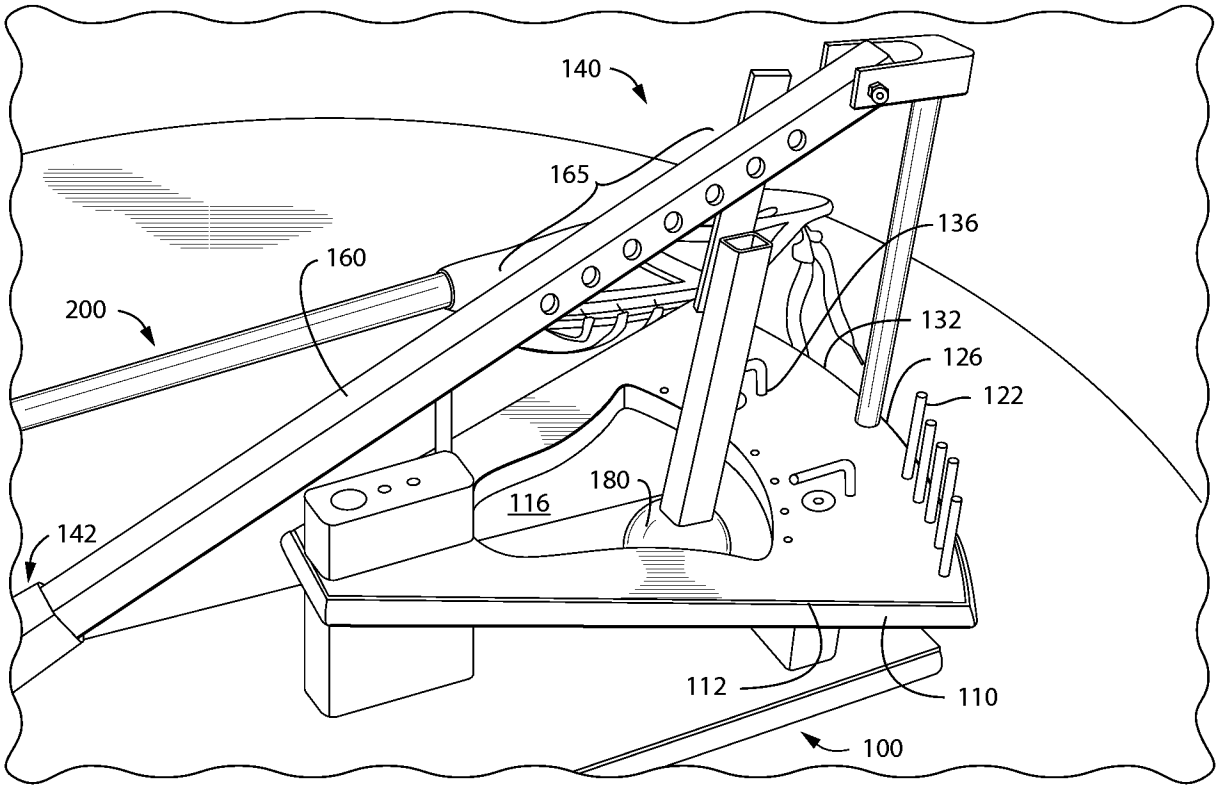
FIG. 1 is a perspective view of one embodiment of a lacrosse stick conditioning apparatus.
Figure 2:
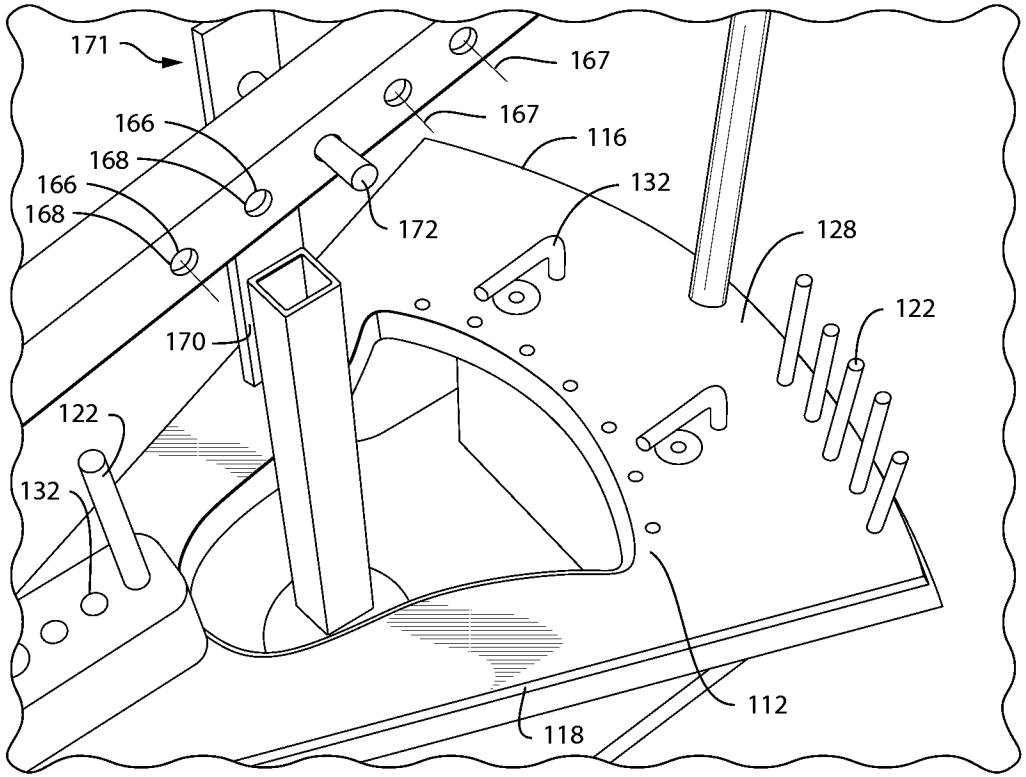
FIG. 2 is a close-up view of the lacrosse stick conditioning apparatus of FIG. 1.
Figure 3:
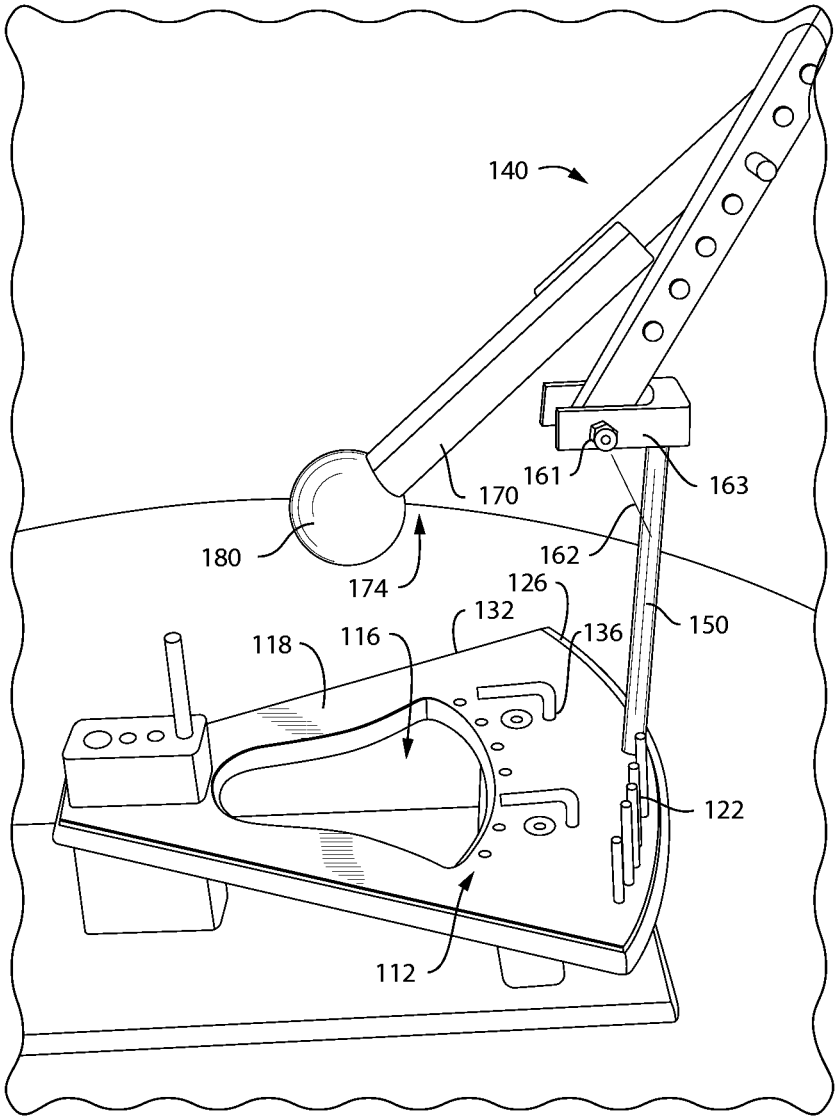
FIG. 3 is a close-up view of the lacrosse stick conditioning apparatus of FIG. 1 in another position.
Figure 4:
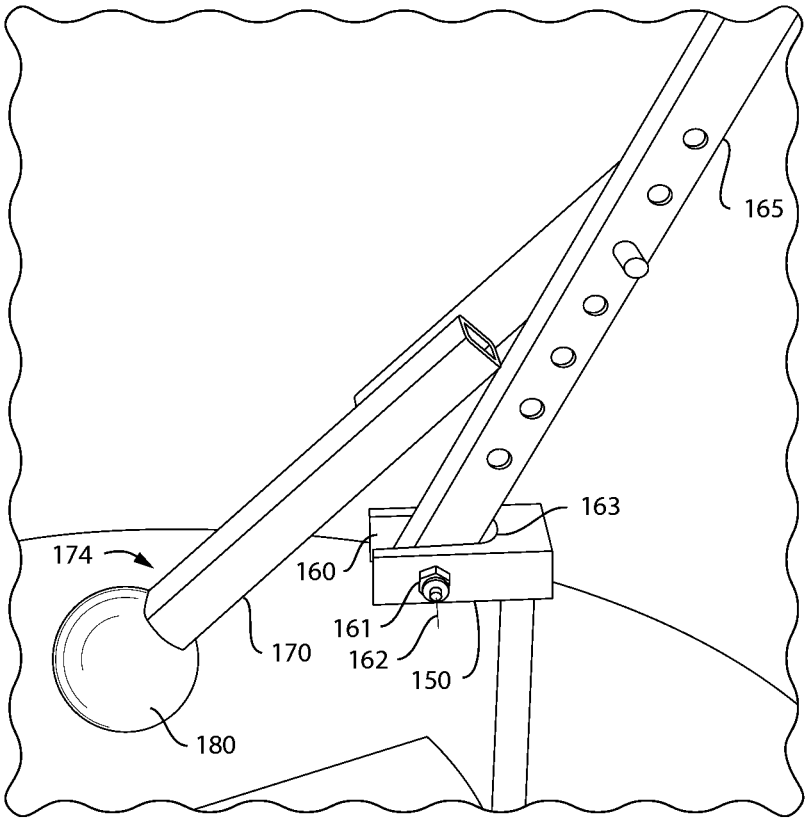
FIG. 4 is close-up view of the coupler of the lacrosse stick conditioning apparatus of FIG. 1.
Figure 5:
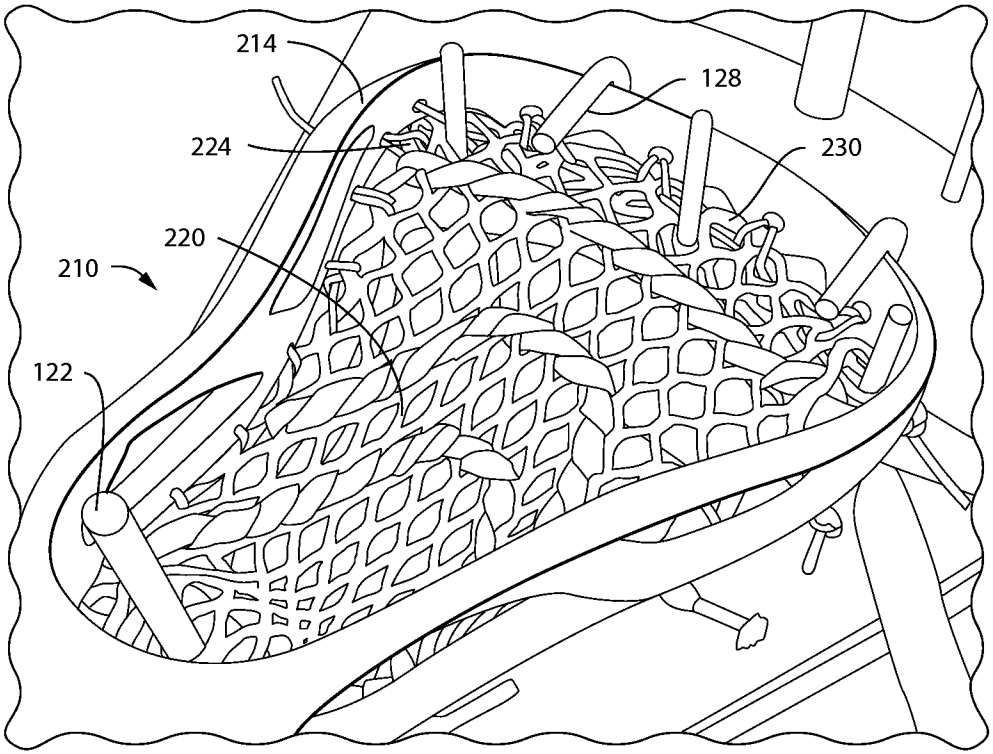
FIG. 5 is a close-up view of the retainer of the lacrosse stick conditioning apparatus of FIG. 1 with an engaged lacrosse stick.
Figure 6:
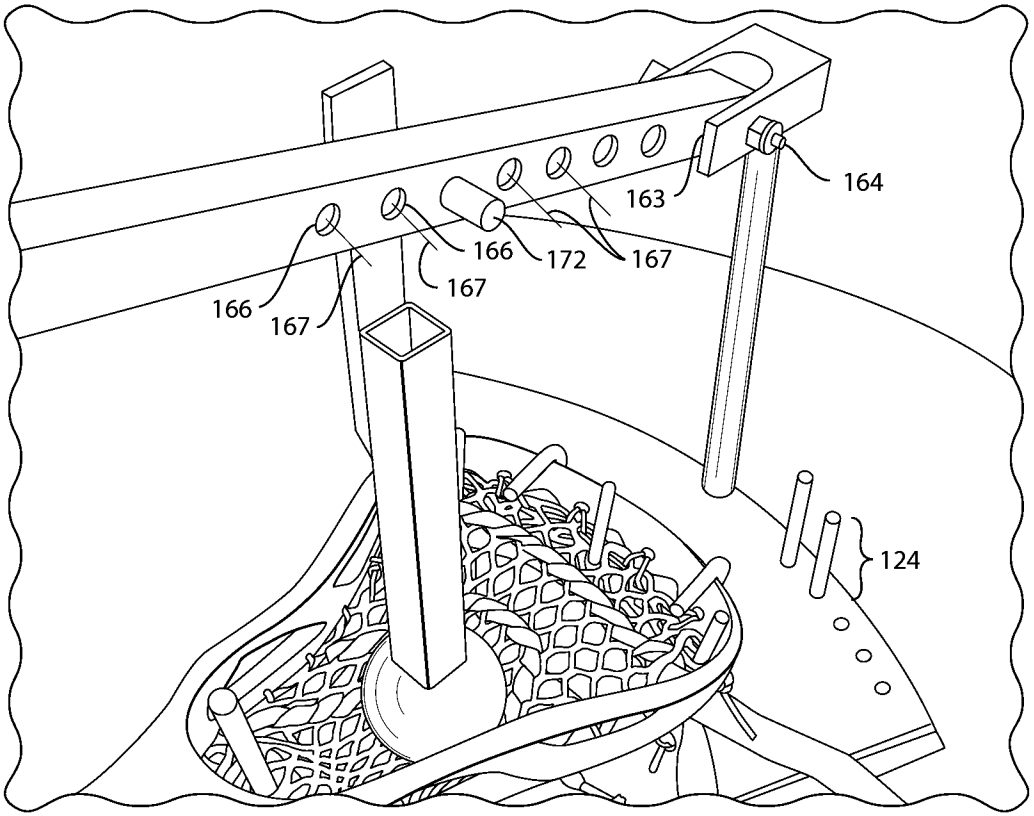
FIG. 6 is a close-up view of the retainer of the lacrosse stick conditioning apparatus of FIG. 1 with an engaged lacrosse stick and with the lever positioned to place the conditioning tool in a first contact position with the lacrosse stick.
Figure 7:
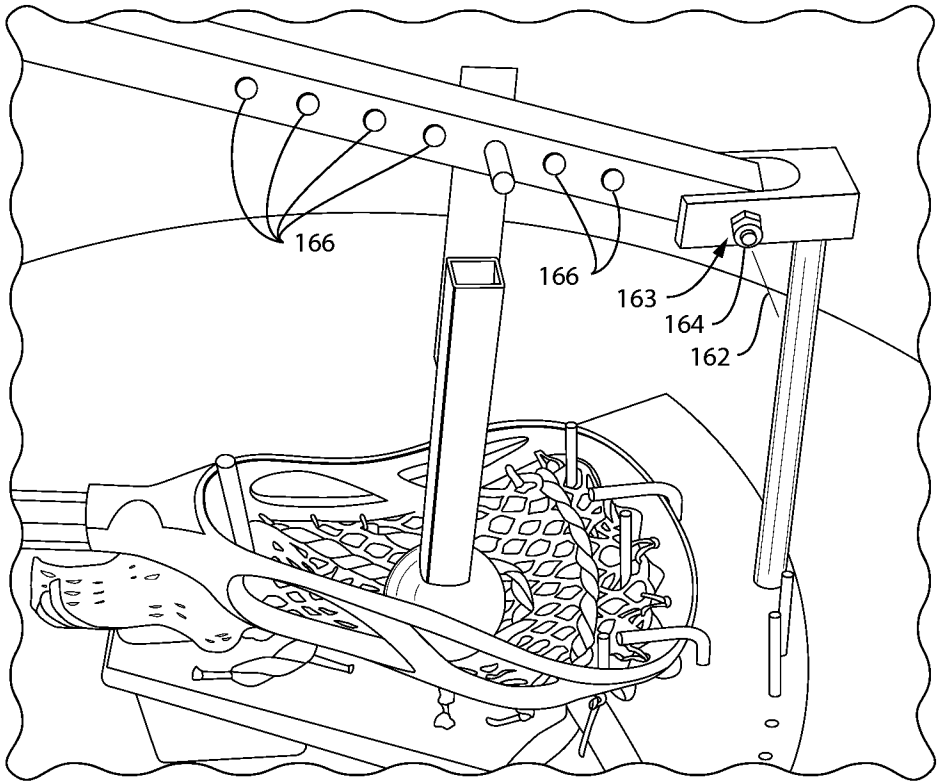
FIG. 7 is another close-up view of the retainer of the lacrosse stick conditioning apparatus of FIG. 1 with an engaged lacrosse stick and with the lever positioned to place the conditioning tool in a first contact position with the lacrosse stick.
Figure 8:
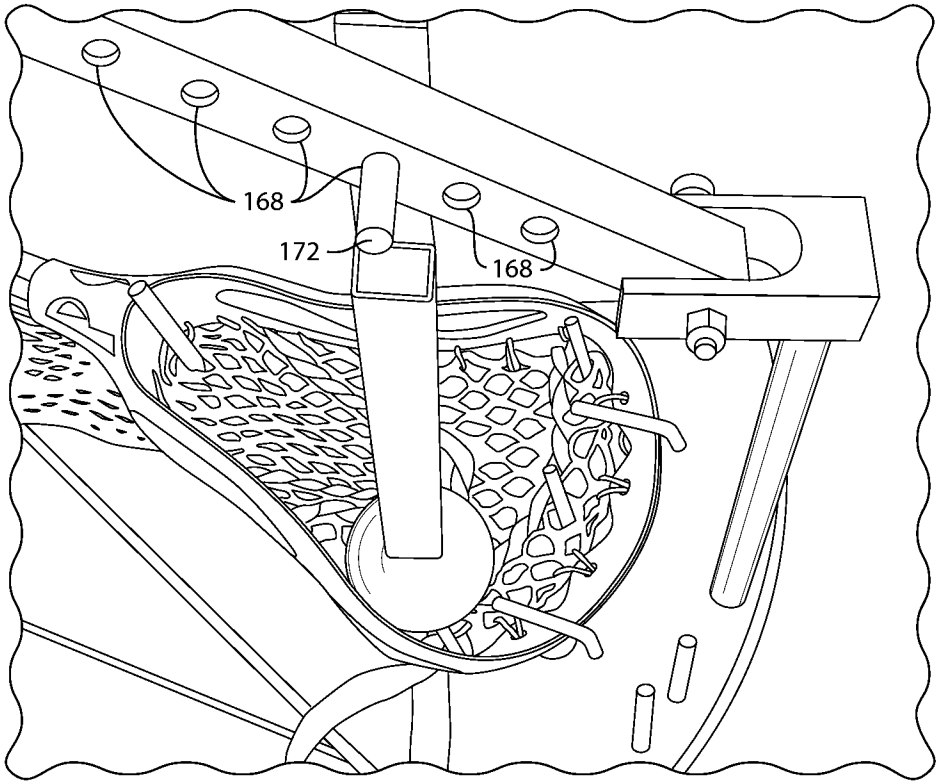
FIG. 8 is a close-up view of the retainer of the lacrosse stick conditioning apparatus of FIG. 1 with an engaged lacrosse stick and with the lever positioned to place the conditioning tool in a second contact position with the lacrosse stick.
Figure 9:
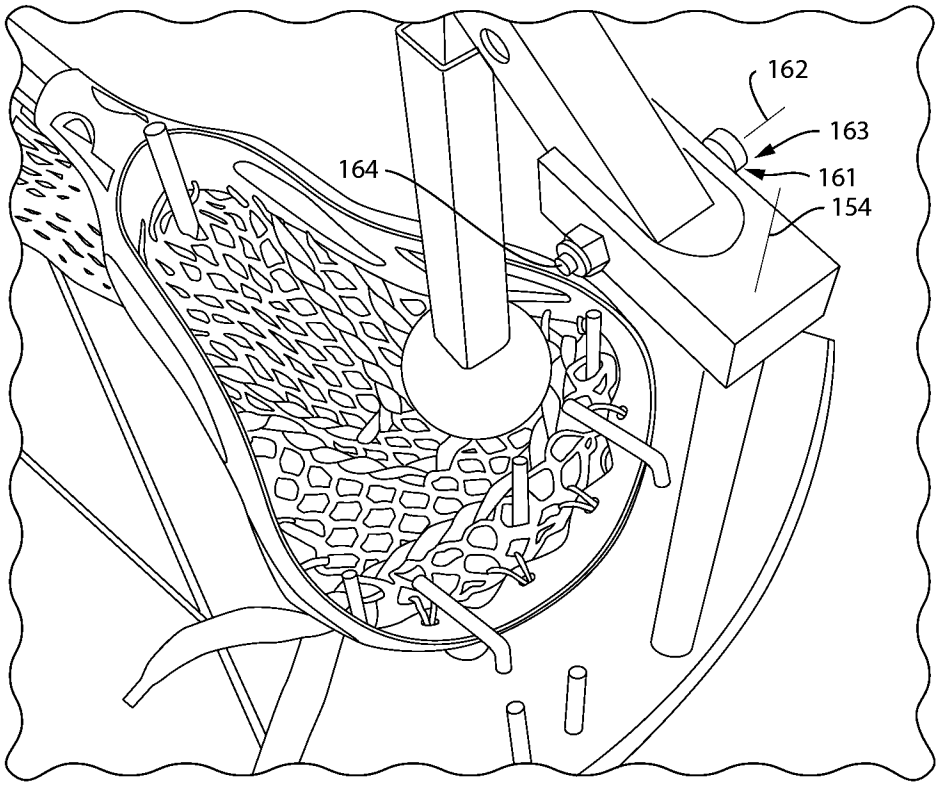
FIG. 9 is a close-up view of the retainer of the lacrosse stick conditioning apparatus of FIG. 1 with an engaged lacrosse stick and with the lever positioned to place the conditioning tool in a third contact position with the lacrosse stick.

Provided is a method and an apparatus 100 adapted to apply any of a range of forces at any of a variety of positions through a conditioning tool 170 to a lacrosse stick 200. Referring now to FIGS. 1-9, shown is one embodiment of a lacrosse stick conditioning apparatus 100 and an associated lacrosse stick 200.

Lacrosse stick conditioning apparatus 100 comprises a retainer 110, a lever 140, and a conditioning tool 170.

Retainer 110 is a component adapted to hold a lacrosse stick 200 in a substantially fixed position with respect to retainer 110. Retainer 110 can comprise a variety of retention components including, but not limited to, a retention cavity 116, a retention surface 112, retention fasteners 122, 126 and retention fastener receptacles 132, 136.

Retention cavity 116 may be shaped to conform to a surface of the associated lacrosse stick 200 such that at least a portion of the lacrosse stick mesh 220 may be nested within retention cavity 116. Retention cavity 116 may be at least partially bounded by a first support surface 118 adapted to support to at least a portion of associated lacrosse stick 200 while leaving a region of the associated lacrosse stick mesh 220 unsupported. In the non-limiting embodiment show in FIGS. 1-9, retention cavity 116 is fully bounded by first support surface 118. First support surface 118 and the retention cavity 116 bounded thereby are substantially bell-shaped to conform to and support the head 210 of lacrosse stick 200. It is contemplated that in other embodiments the first support surface 118 and the retention cavity 116 bounded thereby may be of a different shape. The retention cavity 116 leaves a portion of the mesh 220 of lacrosse stick 200 unsupported such that there is no component immediately below the unsupported portion of mesh 220 to interfere with the imposition of stretching, straining, or deflection of mesh 220.

Retention surface 112 is adapted to support a portion of the associated lacrosse stick 200. Retention surface 112 at least partially bounds and extends away from retention cavity 116. Retention surface 112 is adapted to provide some frictional force to material drawn thereover. In some embodiments, retention surface 112 may comprise grooves, grit, knurling, irregularities, or other features to enhance frictional forces between retention surface 112 and a material drawn thereover. In the non-limiting embodiment shown in FIGS. 1-9, retention surface 112 is adapted to interface with the mesh region 224 proximate to the bounding hoop 214 of head 210. As will be described more fully herebelow, mesh 220 or other material in tension drawn over retention surface 112 will experience a frictional force and, thereby, a resistive force that may be modeled as a braking force. It is contemplated that in other embodiments the amount of frictional force desired may vary according to the user or the nature of the conditioning operation, such that retention surface 112 may comprise features to enhance or minimize frictional forces as may be desired.

Retention fasteners 122, 126 are adapted to operatively engage both retainer 110 and an associated lacrosse stick 200 and to at least partially fix lacrosse stick 200 with respect to retainer 110. Retention fasters 122, 126 may be engaged with retainer 110 as described herebelow. A retention fastener 122, 126 may be straight or curved. A retention fastener 122 may comprise an elongated portion 124 adapted to penetrate a penetratable portion 230, such as and without limitation, mesh 220, of lacrosse stick 200 and thereby to at least anchor, affix, or at least partially limit the motion of the penetrated portion 230 and thereby to at least partially limit the motion of lacrosse stick 200. A retention fastener 126 may comprise an elongated portion 128 adapted to confine or clamp at least part of lacrosse stick 200 and thereby to at least anchor, affix, or at least partially limit the motion of lacrosse stick 200.

A retention fastener 122, 126 may comprise a pin, a bolt, or other fastener. In the non-limiting embodiment shown in FIGS. 1-9, retention fastener 122 is a straight elongated smooth pin adapted to be operationally engaged with retention fastener receptacle 132. As shown in FIGS. 1-9, in some embodiments a lacrosse stick conditioning apparatus 100 may comprise a plurality of retention fasters 122 and retention fastener receptacles 132. Optionally, some of the retention fasters 122 and retention fastener receptacle 132 may differ in size from some of the other retention fasters 122 and retention fastener receptacle 132. Retention fastener 122 and retention fastener receptacle 132 form an interference fit so that, when retention fastener 122 is inserted into retention fastener receptacle 132, retention fastener 122 is retained by friction. The nature of the interference fit between retention fastener 122 and retention fastener receptacle 132 may be chosen with good engineering judgment. In some embodiments, the nature of the interference fit between retention fastener 122 and retention fastener receptacle 132 is such that an associated user may install the retention fastener 122 into or remove the retention fastener 122 from retention fastener receptacle 132 by hand. It is contemplated that other means for engagement between retention fasters 122 and retention fastener receptacle 132 are also acceptable, including, but not limited to, threaded engagement or some sort of permanent engagement such as, without limitation, gluing or welding. In the non-limiting embodiment shown in FIGS. 1-9, retention fastener 126 is an L-bolt adapted to be operationally engaged with retention fastener receptacle 136. Retention fastener 126 is male threaded and retention fastener receptacle 136 is female threaded with threads that are the counter-part to the male threads of retention fastener 126. Retention fastener 126 may be inserted into and threadedly engaged within retention fastener receptacle 136. Other faster components and retention features are contemplated and may be chosen with good engineering judgment. In other embodiments, some fasteners may be permanently mounted. In other embodiments, some fasteners may be adapted to engage a lacrosse stick head 210 of a particular shape, style, or manufacture.

Lever 140 is a device operatively engaged with retainer 110 and with conditioning tool 170. The lever 140 is adapted to move the conditioning tool 170 with respect to the retainer 110 so as to be adapted to do work upon an associated lacrosse stick 200 held by retainer 110. In the non-limiting embodiment shown in FIGS. 1-9, lever 140 comprises an elongated portion 160, one or more conditioning tool mounts 165, a rotatable mount 161 and a handle 142. It is contemplated that operatively engagement between the lever 140 and retainer 110 may take any of a variety of forms, including, without limitation, those forms with one or more intermediary components, such that the lever can apply the needed forces to the associated lacrosse stick 200 engaged with retainer 110.

The rotatable mount 161 defines a primary axis 162 about which the elongated portion 160 may rotate. The rotatable mount 161 may be any feature that permits rotational operational engagement of the elongated portion 160 relative to the retainer 110. In the non-limiting embodiment shown in FIGS. 1-9, rotatable mount 161 is a receiving aperture 163 adapted to accept and rotate with respect to a substantially cylindrical counterpart 164, such as a pin, bolt, shaft, or other similar component. In other embodiments, rotatable mount 161 may comprise a pin, bolt, shaft, hinge, or other similar component adapted to fit within and rotate with respect to a counterpart receiving aperture. In some embodiments, the rotatable mount 161 may optionally comprise a bearing, bushing, lubricating agent, or other component adapted to reduce frictional resistance to rotation. It is contemplated that rotatable mount 161 could be any component or set of components that hold elongated portion 160 in position at primary axis 162 while still permitting elongated portion 160 to rotate about primary axis 162.

The one or more conditioning tool mounts 165 allows for installation of the conditioning tool 170 at any of the conditioning tool mounts 165. Each of the one or more conditioning tool mounts 165 defines a mount axis 167. Each of the one or more mount axes 167 is offset from the primary axis 162. In the non-limiting embodiment shown in FIGS. 1-9, one or more conditioning tool mounts 165 have a plurality of conditioning tool mounts 165 and there are a plurality of mount axes 167 with each mount axis 167 being offset from the primary axis 162 by a different amount than any other mount axis 167. In embodiments in which there are two or more conditioning tool mounts 165, an associated user may move the conditioning tool 170 from one conditioning tool mount 165 to another conditioning tool mount 165, and thereby, based on position of the conditioning tool mounts 165, may select a position to provide a desired work angle or leverage.

Each conditioning tool mount 165 is adapted to hold conditioning tool 170 in position at the mount axis 167 while still permitting conditioning tool 170 to rotate about mount axis 167. In the non-limiting embodiment shown in FIGS. 1-9, each conditioning tool mount 165 is an aperture 168 defining a perimeter 166, where each hole 168 is adapted to accept and rotate with respect to a counterpart, such as a pin, bolt, shaft, or other similar component. As will be described further herebelow, in the non-limiting embodiment shown in FIGS. 1-9, the counterpart 172 which each hole 168 is adapted to accept and rotate with respect to is a component of conditioning tool 170. In some embodiments, one or more conditioning tool mounts 165 may optionally comprise a bearing, bushing, lubricating agent, or other component adapted to reduce frictional resistance to rotation.

Conditioning tool 170 is rotatably engageable with any of the one or more conditioning tool mounts 165. In the non-limiting embodiment shown in FIGS. 1-9, conditioning tool 170 is selectably engageable with any of the one or more conditioning tool mounts 165 in the sense that it may be engaged or disengaged from any of the conditioning tool mounts 165 by an associated user. Conditioning tool 170 may be an elongated member having a first conditioning tool end 171 selectably and rotatably engageable with any of the one or more conditioning tool mounts 165. As noted above, in the non-limiting embodiment shown in FIGS. 1-9, first coupler end 171 has a counterpart 172 which is adapted to be operationally engaged with any of conditioning tool mounts 165 such that conditioning tool 170 may rotate about the mount axis 167 defined thereby. Without limitation, counterpart 172 may be a conditioning tool pin 172 and the holes 168 may be conditioning tool pin receivers 168. Conditioning tool pin 172 may be adapted to be slidably engaged with or disengaged with any of conditioning tool pin receivers 168 by sliding conditioning tool pin 172 along a mount axis 167. In other equally acceptable embodiments, the configuration of counterpart 172 and conditioning tool mount 165 may be any configuration chosen with good engineering judgment which is adapted to selectably hold conditioning tool 170 in position at the mount axis 167 while still permitting conditioning tool 170 to rotate about mount axis 167. In the non-limiting embodiment shown in FIGS. 1-9, conditioning tool 170 has a second conditioning tool end 174 opposite said first conditioning tool end 171 and to which conditioning tool head 180 is engaged.

Conditioning tool 170 is engaged with conditioning tool head 180. The conditioning tool head 180 is adapted to be the contact point between the rest of the lacrosse stick conditioning apparatus 100 and the lacrosse stick 200. In certain embodiments conditioning tool head 180 may be, at least in part, the size and shape of a lacrosse ball for which the lacrosse stick 200 is adapted to be used. In the non-limiting embodiment shown in FIGS. 1-9, conditioning tool 170 has at least one hemisphere that is substantially of the size and shape of one hemisphere of a lacrosse ball. In some embodiments, the conditioning tool head 180 may be slightly larger or smaller than a lacrosse ball in order to accommodate differences in elasticity in the material of different mesh 220 and to accommodate differences in the preferences of different associated users.

In the non-limiting embodiment shown in FIGS. 1-9, lever 140 and conditioning tool 170 form a planar mechanism. Other planar mechanisms and spatial mechanisms are contemplated and may be acceptable alternatives.

One of the features shown in the non-limiting embodiment shown in FIGS. 1-9, is planar selection member 150. Planar selection member 150 is adapted to allow lever 140 to rotate with respect to retainer 110 about a planar selection axis 154. Planar selection axis 154 is different from primary axis 162. In the non-limiting embodiment shown in FIGS. 1-9, planar selection axis 154 is skew to the primary axis 162. In the non-limiting embodiment shown in FIGS. 1-9, planar selection axis 154 is substantially perpendicular to an imaginary line perpendicular to the primary axis 162.

As shown in FIGS. 1-9, handle 142 is an extension of the elongated portion 160. In other embodiments, handle 142 may be engaged with the elongated portion 160 in other ways which permit a user to impart a torsion to elongated portion 160 causing it to rotate about primary axis 162. For example and without limitation, handle 142 may be part of a crank (not shown) engaged at primary axis 162 and offset from elongated portion 160. In still other embodiments, other features may be operationally engaged to impart a torsion to elongated portion 160 causing it to rotate about primary axis 162. For example and without limitation, a motor or spring may be engaged at primary axis 162 to impart a torsion to elongated portion 160. The shown configuration in FIGS. 1-9 is only one of many acceptable ways contemplated to impart torque to elongated portion 160 and any means to impart torque to elongated portion 160 chosen with good engineering judgment is acceptable.

The lacrosse stick conditioning apparatus 100 may be used to condition the mesh 220 of a lacrosse stick 200. Conditioning of the mesh 220 of a lacrosse stick 200 may sometimes involve the formation of a pocket in the mesh 220. A pocket is a depression adapted to accept the lacrosse ball during play. The depth and location of the pocket is usually a matter of user preference, but there are some common generalizations which are not limiting, but aid in understanding pocket forming. In general, a deeper pocket located closer to the base of the head 210 is better at retaining the lacrosse ball during ball carrying operation. In general, a more shallow pocket locate further from the base of the head is better for throwing operations.

The lacrosse stick conditioning apparatus 100 may be used to provide the above referenced pocket in the mesh 220 while allowing an associated user great flexibility in selecting the depth and location of the pocket and also providing great ease in forming the pocket. For sake of illustration, an associated user may introduce a lacrosse stick 200 to the retainer 110; fix the lacrosse stick 200 to the retainer 110 with retention fasteners 122, 126 and position the conditioning tool head 180 at the desired position on the mesh 220. It should be understood that the lacrosse stick conditioning apparatus 100 has sufficient degrees of freedom to permit the conditioning tool head 180 to be placed anywhere within retention cavity 116 and thereby anywhere within the mesh 220 fixed with respect to retainer 110. That is, conditioning tool head 180 may be rotated about the selected mount axis 167, may be rotated about the primary axis 162, and/or may be rotated about planar selection axis 154 in order to position conditioning tool head 180 in the desired location in mesh 220. Once the conditioning tool head 180 is positioned in the desired location in mesh 220, the lever 140 may be used to apply further torque to the elongated portion 160 in order to force the conditioning tool 170 and the conditioning tool head 180 down further, stretching the mesh and deforming the mesh into a pocket of the desired depth.

In some non-limiting embodiments, the associated user may choose among several optional variables in performance of the above described operations. In some embodiments there are many retention fasteners 122, 126, such that an associated user may choose all, any, or none of the retention fasteners 122, 126 to secure the lacrosse stick 200 to the retainer 110. In some embodiments there are multiple interchangeable conditioning tool heads 180, such that an associated user may choose the size of the conditioning tool head 180 to be used in conditioning operations. In some embodiments there are multiple conditioning tool mounts 165, such that an associated user may choose which conditioning tool mounts 165 to which to engage the conditioning tool 170 and thereby, choose the angle of the conditioning tool 170 during operations and the mechanical advantage.

One non-limiting method of using a lacrosse stick conditioning apparatus 100 is provided by the following steps which need not necessarily be performed in the order provided. Provide a lacrosse stick conditioning apparatus comprising a retainer adapted to hold a lacrosse stick in a substantially fixed position relative to the retainer; a lever rotatably mounted relative to the retainer at a primary axis, the lever having one or more conditioning tool mounts where each conditioning tool mount is adapted for pivotable engagement of a conditioning tool and defines a mount axis parallel to and offset from the primary axis; and a conditioning tool rotatably engageable with any of the tool mounts and having a conditioning tool head engaged therewith. Provide a lacrosse stick. Fix the position of the lacrosse stick with respect to the retainer. Operate the lever to apply work to the lacrosse stick through the conditioning tool.

It should be understood that the provided subject matter is readily adaptable to use with other sporting good articles such as, without limitation, a baseball glove. Additionally, this device is not seen as limited to the sport of lacrosse or lacrosse equipment, but could be used in connection similar sports regardless of its name or with any type of sporting equipment which utilizes a mesh or pocket used to receive and/or toss a ball or game piece.

While the above subject matter has been illustrated and described in detail in the drawings and foregoing description, the same is to be considered as illustrative and not restrictive in character, it being understood that exemplary embodiments have been shown and described and that all changes and modifications that come within the spirit of the invention are desired to be protected by the appended claims and the equivalents thereof.

What is claimed is:

1. A lacrosse stick conditioning apparatus, comprising:

a retainer adapted to hold a lacrosse stick in a substantially fixed position relative to said retainer;

a lever rotatably mounted relative to said retainer at a primary axis, the lever having one or more conditioning tool mounts, each mount, being adapted for pivotable engagement of a conditioning tool, and defining a mount axis parallel to and offset from the primary axis a conditioning tool rotatably engageable with any of said tool mounts and having a conditioning tool head engaged therewith.

2. The lacrosse stick conditioning apparatus of claim 1, wherein the first member is rotatably engaged to the retainer by a planar selection member which is rotatable relative to the retainer around a planar selection axis which is skew to the primary axis.

3. The lacrosse stick conditioning apparatus of claim 2, wherein the planar selection axis is parallel to an imaginary line perpendicular to the primary axis.

4. The lacrosse stick conditioning apparatus of claim 3, wherein the coupler engagement feature set has at least two conditioning tool mounts.

5. The lacrosse stick conditioning apparatus of claim 4, wherein the conditioning tool is an elongated member having, a first conditioning tool end selectably and rotatably engageable with any of said conditioning tool mounts; and a second conditioning tool end opposite said first conditioning tool end, and to which said conditioning tool head is engaged.

6. The lacrosse stick conditioning apparatus of claim 5, wherein the lever is elongated having, a first lever end at which said lever is mounted relative to said retainer, and a second lever end opposite said first lever end and at which a handle is operationally engaged.

7. The lacrosse stick conditioning apparatus of claim 6, wherein the first conditioning tool end has a tool pin; and each of conditioning tool mounts has an aperture adapted to selectably and rotatably engage the tool pin.

8. The lacrosse stick conditioning apparatus of claim 7, wherein the retainer further comprises a retention cavity, a retention surface, and a first type of retention fastener receptacle.

9. The lacrosse stick conditioning apparatus of claim 8, wherein the first type of retention fastener receptacle is adapted to operationally engage a retention pin.

10. The lacrosse stick conditioning apparatus of claim 9, wherein the conditioning tool head has at least one hemisphere that is substantially of the size and shape of one hemisphere of a lacrosse ball.

* * * * *